US005796022A

United States Patent [19]

Miller

[11] Patent Number: 5,796,022

[45] Date of Patent: Aug. 18, 1998

[54] HELICAL AIR PATH INDUCTION IN WIND INSTRUMENTS

[76] Inventor: Robert W. Miller, 868 E. 7th St., Moscow, Id. 83843

[21] Appl. No.: 775,320

[22] Filed: Dec. 31, 1996

[51] Int. Cl.[6] ..... G10D 7/00; G10D 7/02; G10D 7/06; G10D 7/08

[52] U.S. Cl. ..... 84/380 R; 84/382; 84/384; 84/385 R; 84/387 R; 84/395

[58] Field of Search ..... 84/380 R, 382, 84/384, 385 R, 387 R, 395

[56] References Cited

U.S. PATENT DOCUMENTS 5,261,308 11/1993 Yamauchi ..... 84/384

5,287,785 2/1994 Miller ..... 84/391

5,299,486 4/1994 Weingrill ..... 84/340 R

*Primary Examiner*—Michael L. Gellner

*Assistant Examiner*—Daniel Chapik

*Attorney, Agent, or Firm*—Wells, St. John, Roberts, Gregory & Matkin P.S.

[57] ABSTRACT

A wind instrument is described which includes an elongated tubular body and a helical member in the tubular body extending longitudinally therein for inducing a helical airflow in the tubular body from air blown into the mouthpiece. A helical member is also described for insertion within a wind instrument to induce helical airflow through at least part of the instrument.

13 Claims, 5 Drawing Sheets

HELICAL AIR PATH INDUCTION IN WIND INSTRUMENTS

TECHNICAL FIELD

The present invention relates to musical instruments and more particularly to airflow through wind instruments.

BACKGROUND OF THE INVENTION

Wind instruments rely on the passage of air at various volumes, pressures, and air speed, along with vibration of reeds, the player's lip pressure, or other sound producing effects to produce tones. Tones may be made to vary by the player selectively controlling the above conditions, and by changing the effective length of the instrument, as with slide trombones, valving in trumpets or other valved wind instruments, or by covering and uncovering tone holes as with saxophones, clarinets, flutes, oboes, etc.. With most present instruments, tonal quality is influenced both by the player's ability, and by the quality of the instrument.

Air passage through a wind instrument is confined by the tubular body of the instrument. In reed instruments, air is allowed to escape short of the bell or open end (or ends) of the instrument by selectively uncovering tone holes. In many but the simplest instruments, such holes are covered by pads connected to keys that can be operated by the player's fingers to open and close, effecting selective changes in the air passage and the instrument operating length. In brass instruments, with the exception of the slide trombone, valves are typically used to alter the effective instrument length by altering the passage of air through shorter or longer passageways provided in the instrument.

In reed, flute or brass wind instruments, air moves through the instrument bore in somewhat of a column that is controlled only by the inside shape of the instrument bore. No studies known to the present inventor have been conducted regarding air flow through wind instruments, but it is suggested at least in theory that migrant eddy currents or dead air spaces likely occur especially in areas along the instrument where the cross sectional bore dimension is increased, or at areas distant from the mouthpiece. Such anomalies will occur at various locations along the instrument tube according to the applied air pressure and keying or valving of the instrument, and can have a negative effect on instrument tone. Impure tones, unintended octave shifts or "squawking", and "gurgling" of low tones are believed to be caused at least in part by this theoretical phenomena.

It has long been assumed that any obstruction within the bore of a wind instrument will have an adverse effect on the instrument's tonal quality and playability. A result of this assumption is that few if any attempts have been made to counter the unintentional formation of dead air spaces or eddy currents within the instrument bores by placement of anything in the instrument bore that would encounter and change airflow.

Consequently instrument makers still strive to produce instruments with inside bore surfaces as free as possible of any impediment. The bores of flutes, piccolos and "whistle" type instruments such as organ pipes, recorders, and the like, are nearly perfectly cylindrical and unobstructed from the mouthpiece to the open end. This goal is also evidenced in any brass instrument by the instrument bore which tapers smoothly from a small opening at the mouthpiece to the flared bell, by the graceful curvature of the instrument tube, and by the smooth transitions through valving.

While it is agreed that certain bore obstructions can result in poor instrument performance, it has been found (contrary to popular belief) that through advent of the present invention, tonal quality can actually be distinctly improved by placement of an object within the instrument bore that will induce a helical airflow. The primary object of the present invention is therefor to provide a member within a wind instrument body, directly in the air flow path, that will induce a helical airflow, and by so doing substantially improve the air passage through the instrument, tonal qualities, and "playability" of the instrument.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
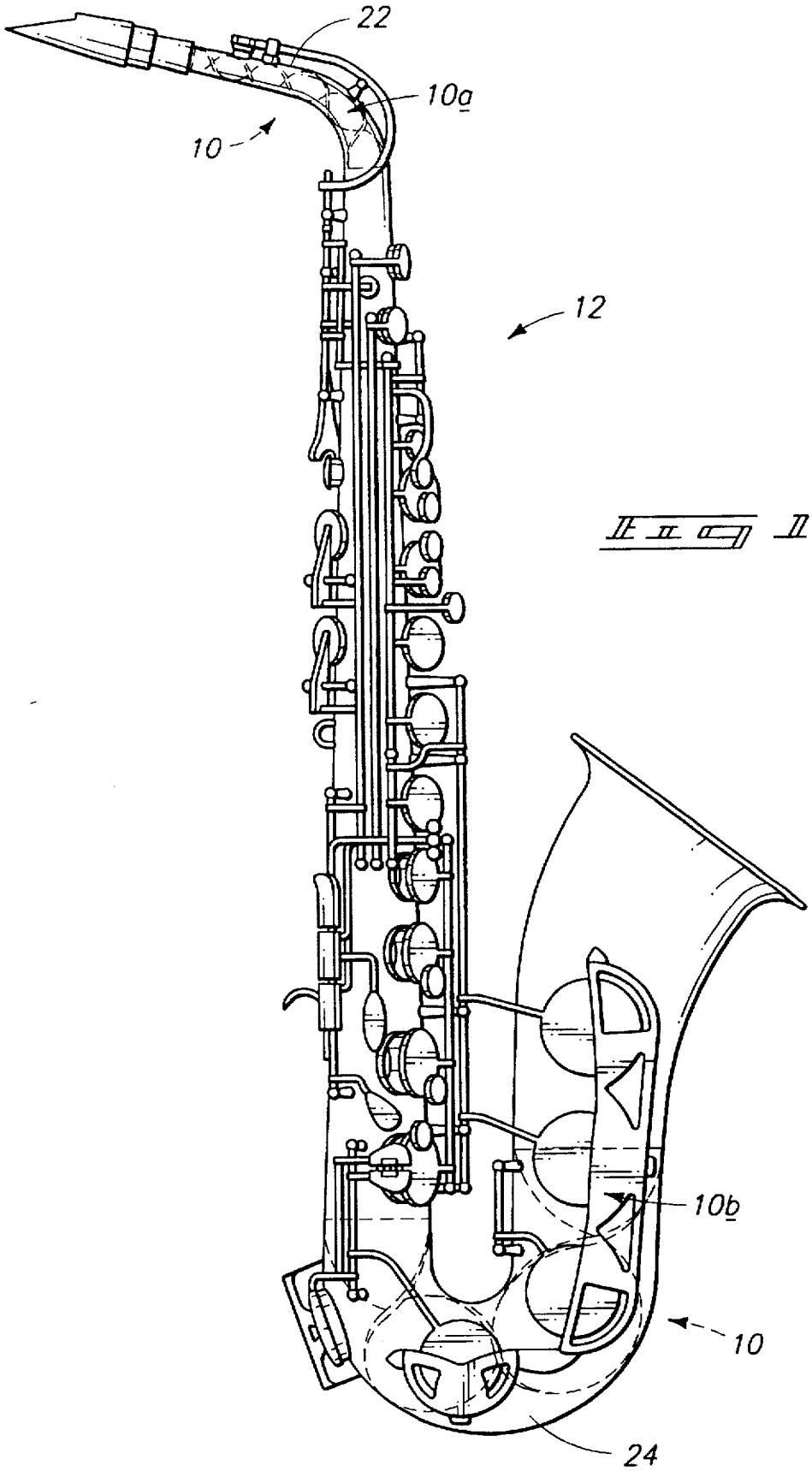
FIG. 1 is a side elevation diagrammatic view of a saxophone incorporating features of the present invention.

This disclosure of the invention is submitted in furtherance of the constitutional purposes of the U.S. Patent Laws "to promote the progress of science and useful arts" (Article 1, Section 8).

The present invention is embodied in a helical member generally referred to at 10 in the drawings, for inducing a helical airflow in a wind instrument. As used herein, the term "helix" or helical should be understood as relating to a curve generated by a point moving about a real or imaginary curved surface (cylindrical, conical or otherwise shaped) at a constant or variable rate in the direction of an axis of the real or imaginary surface. Thus a "helix" on a conical surface would resemble a spiral in end view with the axis appearing as a point. The above definition varies somewhat from the standard meaning of the term "helix" since the present helical member may not be "constant" in that its pitch or lead may vary.

As used herein, a "wind instrument" is to be understood as any musical device that is operated using flowing air from a human or another source to at least assist generation of a musical tone. As such, the wind instrument will include an instrument body B, an input device such as a mouthpiece M and, in more sophisticated instruments, one or more instrument length affecting devices such as tone holes H and pads P in woodwind instruments, or valves V in brass instruments. The body B will in all cases include an internal bore defined by an internal wall surface S.

Variations of the above generic components will occur, depending upon the nature of the instrument. For example a trombone uses a slide to vary the effective instrument length, thus functioning as a valve. An organ pipe may include a "whistle" part as an input device ahead of a plain tubular body that may not include valves or tone holes. Regardless of such differences, all wind instruments will make use air flowing through a hollow body to affect tonal generation.

The present helical member 10 may be produced in any of several embodiments. Several examples are shown in the drawings and will be described below. Other combinations or subcombinations or variations are also envisioned and that fall within the scope of the claims following this description.

It is pointed out that the preferred member 10 may optionally be: [a] integrated with a wind instrument (formed with or secured to the instrument as it is manufactured), [b] provided individually to be inserted within an existing wind instrument, or [c] manufactured within a wind instrument part that may be substituted for a similar wind instrument part (for example a member 10 may be produced simultaneously or integrally with a separable wind instrument part such as a neck, bowl, extension, mouthpiece, etc. as a replacement for a similar separable part of a standard instrument).

More specifically, in first preferred forms, the helical member 10 is a sheet, rod or ridge formed in an elongated helix, of a relatively rigid material such as thin sheet metal. The material may be integral with the wind instrument, be attached permanently, or removably secured thereto. In alternate forms, the helical member 10 is formed as a recess or groove in a sleeve received in the instrument or formed integrally in the instrument body.

The material used for the insert forms of the present helical member is preferably a ductile metal that is compatible with the instrument in which the helical member is to be used. For example a brass helix member would be suitable for brass instruments. Copper has also been found to function well, though other materials including plastic could be used.

The selected material for formation of the insert forms of the present helical member must be of sufficient dimension and rigidity to induce a helical pattern in air flowing through the instrument and yet minimize volumetric displacement within the instrument bore.

The length of the helical member 10 may vary according to the instrument. For example a piccolo would use a proportionally different sized and shaped member 10 than, say, a tuba. It is most desirable to maximize the length dimension of the member 10 within the subject instrument bore without adversely affecting the function of various slides, valves, or tone holes that are typically found along the instrument length. However, it is usually impractical (with the possible exception of organ pipes) to provide a helical member that extends the full instrument length. In fact, tonal improvement has been obtained with members 10 occupying lengths substantially less than the full instrument length, as exemplified by the members 10 shown by dashed lines in FIGS. 1–3. At a minimum then, the member should be at least approximately 15% of the overall instrument length to improve tonal quality.

The rate of twist or "lead" in the helix configuration of a helical member 10 may also be a variable according to the instrument and the area of the instrument in which the device is being used. As an example, it has been found that a "lead" (distance the helix advances axially through a full 360° turn) of the helical member in an approximate ⅜" diameter bore of a trumpet lead pipe is approximately 3 to 3.5 inches. A tighter lead could adversely affect air passage and create back pressure.

Another variable considered is the shape of the outer edge of the helical member. The shape will preferably match that of the internal surface S of the instrument in the area where the helical member is to be located. Thus a bell shaped area of an instrument will naturally accept a similarly bell shaped helical member. It is noted that it is not necessary for the edge of the helical member to be in intimate engagement with the adjacent inner surface S of the instrument. In fact, the helical member 10 could be suspended within the instrument without any substantial part of the member touching the adjacent internal surface of the instrument.

Application of the present invention is shown by several examples illustrated in the drawings.

Figure 2:
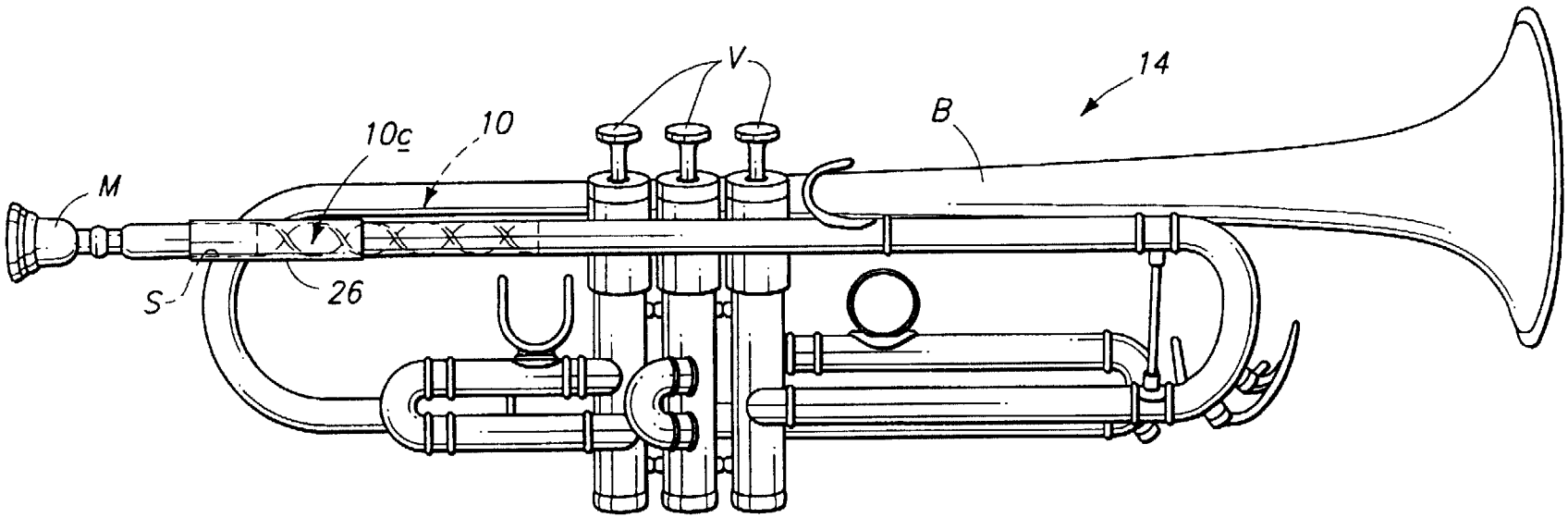
FIG. 2 is a side elevation diagrammatic view of a trumpet incorporating features of the present invention.
Figure 3:
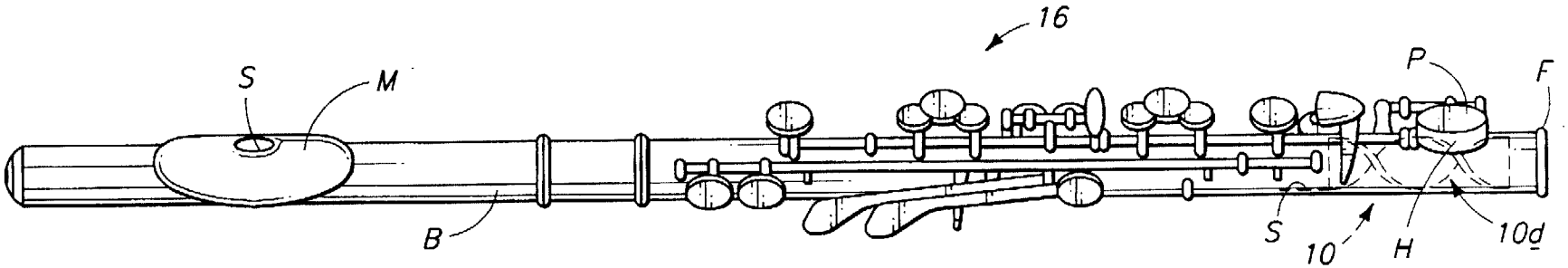
FIG. 3 is a side elevation diagrammatic view of a flute incorporating features of the present invention.

FIGS. 1–3 show respectively, a saxophone 12, a trumpet 14, and a piccolo 16. These instruments are simply provided as examples of species from the wind instrument genus and to show exemplary placement of the helical members 10 therein. It is believed that the present invention can be adapted to or integrated with nearly any wind instrument.

With reference to the saxophone 12 in FIG. 1, two helical members **10*a* and 10*b* are is shown by dashed lines in two locations. A first member 10*a* is situated within the neck 22 of the saxophone 14, and the second 10*b* is located within the saxophone bowl 24. It is pointed out, however that tonal quality is improved with only one member 10*a* or 10*b* in place. But placement of the two members as shown improves tonal quality through a greater range than, say, placement of only one member 10*a* in the neck 22 or one member 10*b* in the bowl 24**.

Attention is drawn to the variation in shape between member **10*a* and member 10*b*. Member 10*a* is shaped in a bend to accommodate the bend of the saxophone neck 22, and is sized in cross section to match the inward surface S of the saxophone within the adjacent neck area. Member 10*b*, on the other hand, is bent and flared to match the internal surface S at the bowl 24**. This difference exemplifies the variety of member shapes discussed above. Note is also made that the members are oriented in such a manner that no part of the adjacent tone holes are crossed by the outer edges of the helical members.

It is noted that the members **10*a* or 10*b*** may be provided separately from the instrument and be physically inserted into the neck and bowl. Alternatively the members can be produced integrally with the saxophone. Further, the members can be produced simultaneously with neck and bowl pieces to replace conventional neck and bowl pieces of a standard saxophone.

The trumpet 14 exemplified in FIG. 2 includes an elongated helical member **10*c* within the lead pipe 26. Since lead pipes 26 are typically straight and the bore formed by its internal surface S is cylindrical, the member 10*c* may be similarly shaped. It is noted in this example that the member 10*c* may be integrated with the trumpet, or be provided as an insert that can be slid into position within the lead pipe, or the member 10*c* can be produced simultaneously with a lead pipe for replacement of a standard lead pipe in a conventional trumpet. It is also conceivable (though not shown) that the member 10***c* could be integrated with or inserted into the mouthpiece M of the trumpet.

The piccolo 16 exemplified in FIG. 3 includes an elongated helical member 10*d* within the tubular body B near a foot end F. This is done to induce a helical airflow along the body from the foot end F where air enters (due to the venturi effect produced by blowing across the mouthpiece M). The exemplary member 10*d* extends only past one or two tone holes and does not extend the full length of the body B.

The piccolo 16, as with the other examples described above, can be manufactured with the helical member 10*d* integrated in the body. Alternatively, the member 10*d* may be produced separately to be inserted in the foot end F of a conventional piccolo. Further, the foot end F could be manufactured with a helical member 10*d* therein, for attachment as an extension or a replacement of an existing foot on a conventional piccolo.

FIGS. 4–10 are included to illustrate various (not exclusive) forms which the present helical member may take.

Figure 4:
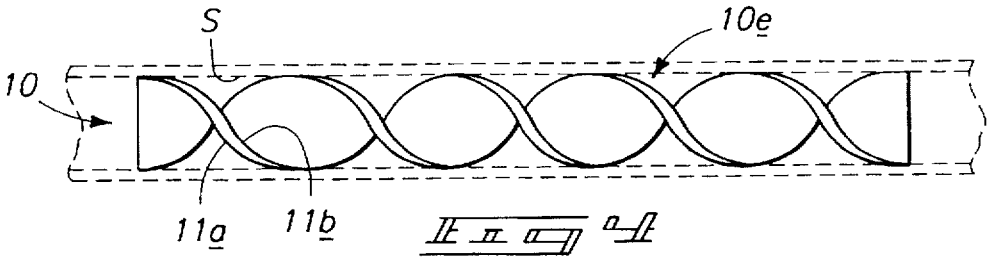
FIG. 4 is a side elevation view of a ribbon insert version of the present invention in which the ribbon spans the diameter of the instrument bore.
Figure 8:
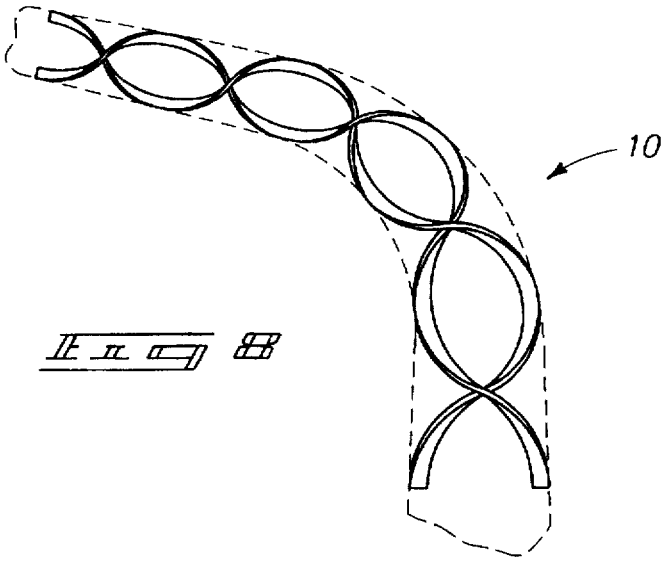
FIG. 8 is a diagrammatic view illustrating how the present helical member may be bent to conform with various curvatures of wind instrument bodies.

In FIG. 4, a helical member 10*e* is shown formed by a ribbon of material intended to span the diameter of internal bore of an instrument. Though the axis of the helix is shown to be straight, it is entirely feasible that the ribbon be bent in addition to the helical twisting in order to conform to similar bends along an instrument body. One exemplary bend is shown in FIG. 8.

Figure 5:
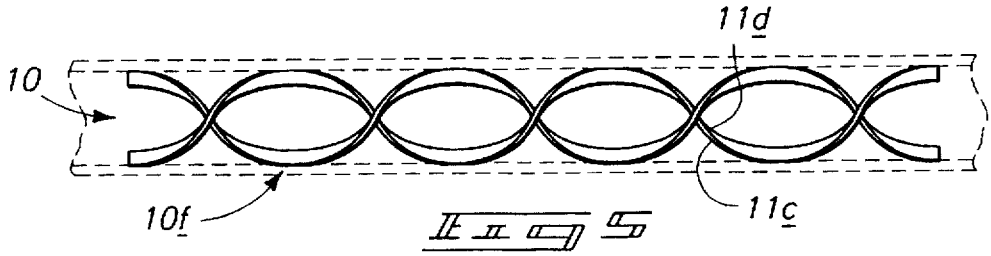
FIG. 5 is a side elevation view of a ribbon insert version of the present invention in which the ribbon spans part of the diameter of the instrument bore.

In FIG. 5, a helical member 10*f* is shown formed by a radially narrower ribbon (as compared to member 10*e* in FIG. 4). In this form, the member 10*f* does not span the bore diameter of the instrument, but merely projects into the bore, leaving the core of the bore unobstructed. Another similar member may also be used as shown by dashed lines in FIG. 5 to further induce helical air flow.

The helical members 10 in the above forms have preferred thickness dimensions between opposed side surfaces 11*a*, 11*b* (FIG. 4) or 11*c*, 11*d* (FIG. 5) within a range of approximately 0.003 to 0.010 inches for an average size instrument such as a saxophone. The thickness dimension may vary proportionally with the size of the instrument.

Figure 6:
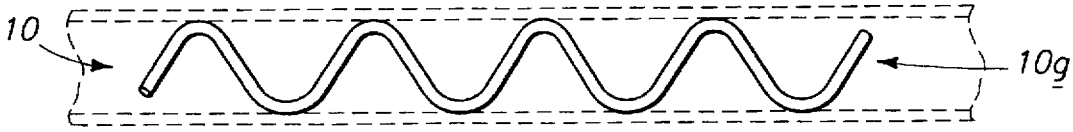
FIG. 6 is a side elevation view of a rod shaped into a helix version of the present invention.

In FIG. 6 a helical member 10*g* is shown formed of an elongated rod 30 bent into an elongated helix for insertion longitudinally into the tubular body of an instrument. Multiple similarly bent rods 30 may be used in the same axial extent of an instrument to further induce helical air flow. The rod or rods may be of rectangular, circular, or other appropriate cross-sectional shape.

Figure 7:
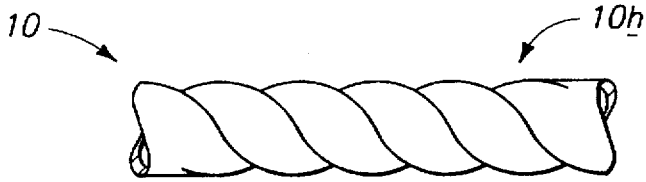
FIG. 7 is a side elevation view of a portion of an instrument body twisted into an integral helical embodiment of the present invention.

In FIG. 7, a helical member 10*h* is shown as an integral twisted a part of an instrument body (only a portion of which is shown). Here at least part of the instrument (say the lead pipe of a trumpet) is twisted in a helical fashion as the instrument body is shaped, and the actual internal surface of the instrument thereby becomes the helical member.

Figure 9:
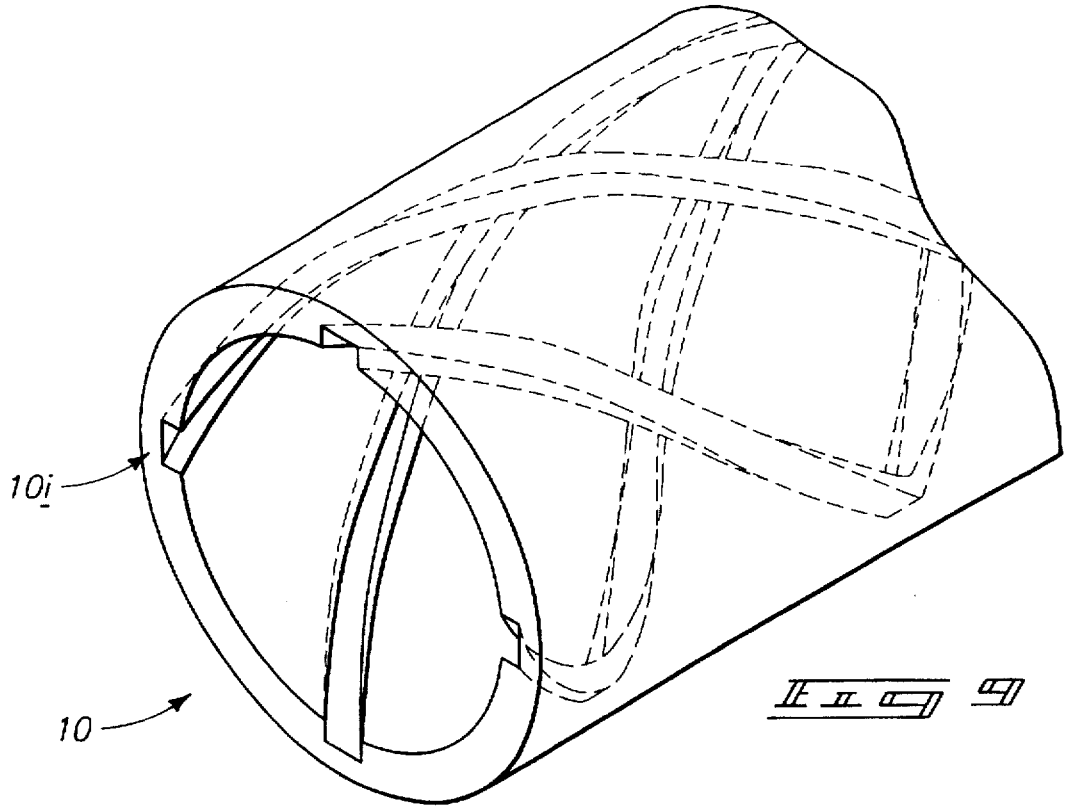
FIG. 9 is a fragmented section shown in perspective of a portion of an instrument in which the present helical member is formed as a helical groove.

In FIG. 9 a helical member 10*i* is formed integrally within a tubular member 32. The helical shape may be formed using existing technology (milling, extruding, forging, die stamping, casting, etc) to produce helical members as incised fluting along the internal surface of the tubular member 32. The tubular member 32 can then become a part of an instrument, such as the lead pipe of a trumpet. The fluted member 32 can also be bent into typical instrument shapes, or flared as needed for instrument production. The flutes could extend part or the full length of the instrument body.

Figure 10:
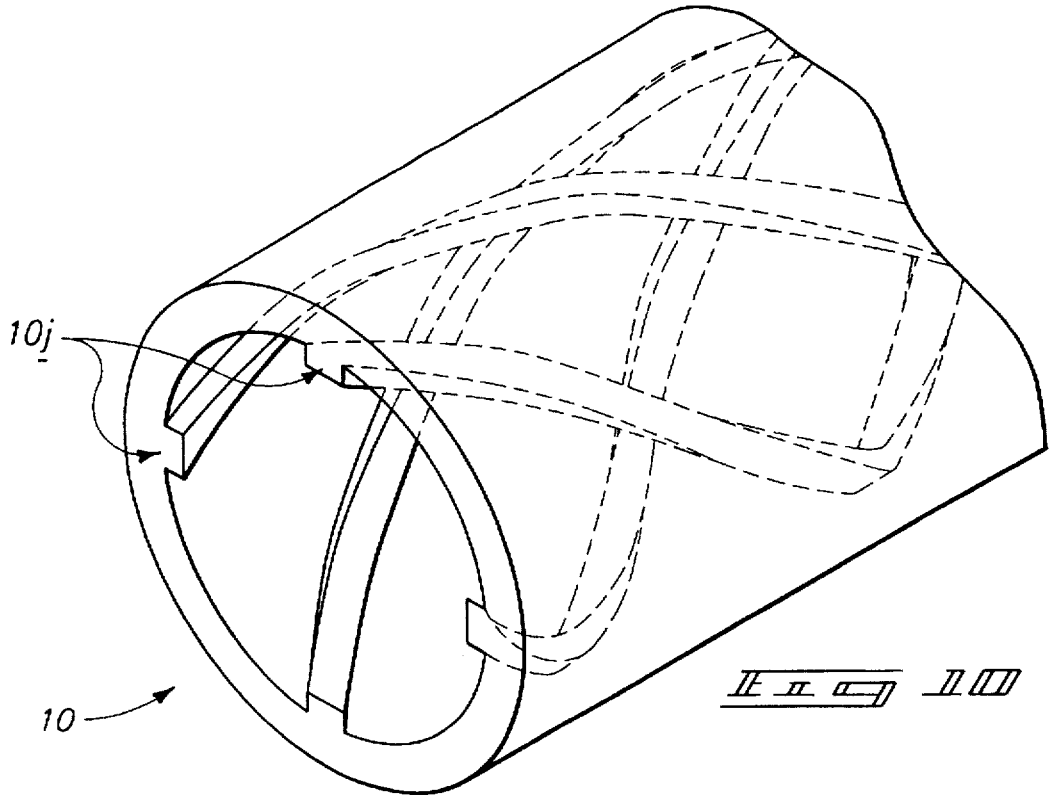
FIG. 10 is a view similar to FIG. 9 only showing the helical member as helical protrusions within the instrument body.

FIG. 10 shows a helical member 10*j* in which flutes are formed to project into the bore of a tubular member 34. The flutes may be formed using technology and apparatus as described above, and the resulting tubular member may be shaped in a similar or identical fashion.

It is pointed out that any one or combination of the configurations described above may be produced integrally within an instrument, be produced separately and inserted into an existing instrument, or be produced simultaneously with a replacement part for an instrument.

It is also pointed out that none of the embodiments or variations described need alter the existing accepted shape of a wind instrument. In fact many installations may be made with the member 10 hidden within the bore of the instrument and be invisible from the outside. The aesthetic appearance of the instrument need not be affected.

In operation, the present helical member will act to induce a similarly shaped helical air flow in air passing through the instrument as the instrument is played. Air flow through the instrument thus becomes controlled, consistent and predictable. The end result is a remarkably cleaner, purer tone and easier "play" than can be achieved with the same instrument and player but without the present invention in place. Surprisingly, this effect is achieved without any noticeable impediment to airflow through the instrument, even though the helical member or members are positioned directly in the air passage, and obviously occupy a certain percentage of the instrument bore volume.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A wind instrument, comprising:

an elongated tubular body; and a helical member in the tubular body and extending longitudinally therein for inducing a helical airflow in the tubular body from air passing through the instrument.

2. A wind instrument as defined by claim 1 wherein the helical member is formed integrally in the tubular body.

3. A wind instrument as defined by claim 1 wherein the tubular body includes a mouthpiece at one end and wherein the helical member is situated within the tubular body adjacent the mouthpiece.

4. A wind instrument as defined by claim 1 wherein the tubular body includes an open end and wherein the helical member is situated within the tubular body adjacent the open end.

5. A wind instrument as defined by claim 1 wherein the helical member is formed of an elongated rod bent into an elongated helix and inserted longitudinally into the tubular body.

6. A wind instrument as defined by claim 1 wherein the tubular body includes an interior surface forming a bore extending through the tubular body and wherein the helical member is formed of an elongated member bent into a helical configuration and releasibly inserted into the bore.

7. A wind instrument as defined by claim 1 wherein the tubular body includes an interior surface forming a bore extending through the tubular body and wherein the helical member is affixed to the interior surface.

8. A wind instrument as defined by claim 1 wherein at least part of the tubular body is twisted to form the helical member.

9. A wind instrument as defined by claim 1 wherein the tubular body includes an internal surface defining a bore and wherein the helical member is formed as a helical groove cut into the internal surface.

10. A wind instrument as defined by claim 1 wherein the helical member is formed of an elongated ribbon of flexible material twisted into an elongated helical configuration and disposed longitudinally within the tubular body.

11. A helical air path inducing insert for a wind instrument having a hollow bore formed by an internal surface, comprising:

an elongated member formed in an elongated helix and having an external edge surface configured to fit against the internal surface of the wind instrument to induce a helical airflow through the wind instrument.

12. A wind instrument as defined by claim 11 wherein the elongated member is a twisted ribbon.

13. A wind instrument as defined by claim 11 wherein the elongated member is a rod formed into a helix configuration to match at least part of the internal surface of the wind instrument.

* * * * *